US007124746B2

(12) United States Patent
Brocco et al.

(10) Patent No.: US 7,124,746 B2
(45) Date of Patent: Oct. 24, 2006

(54) METHOD AND APPARATUS FOR CONTROLLING A FUEL INJECTOR

(76) Inventors: Douglas S. Brocco, 113 Park La., Waterloo, IA (US) 50702; Dana R. Coldren, 40 Lakeview Dr., Fairbury, IL (US) 61739; Daniel R. Ibrahim, 420 Mackenzie Pl., Metamora, IL (US) 61548; Berfan K. Kochgiri, 2329 W. Jubilee La., Dunlap, IL (US) 61525

( * ) Notice: Subject to any disclaimer, the term of this patent is extended or adjusted under 35 U.S.C. 154(b) by 338 days.

(21) Appl. No.: 10/196,645

(22) Filed: Jul. 16, 2002

(65) Prior Publication Data

US 2004/0011331 A1 Jan. 22, 2004

(51) Int. Cl.
*F02M 37/04* (2006.01)

(52) U.S. Cl. ..... 123/500; 123/496

(58) Field of Classification Search ..... 123/458, 123/496, 500, 501, 456, 299, 300
See application file for complete search history.

(56) References Cited

U.S. PATENT DOCUMENTS

| | | | | |
|---|---|---|---|---|
| 4,349,152 | A | 9/1982 | Akagi | |
| 4,475,515 | A | 10/1984 | Mowbray | |
| 4,603,671 | A | 8/1986 | Yoshinaga et al. | |
| 4,627,403 | A * | 12/1986 | Matsumura | 123/447 |
| 4,674,688 | A | 6/1987 | Kanesaka | |
| 5,441,029 | A | 8/1995 | Hlousek | |
| 5,497,750 | A | 3/1996 | Mueller et al. | |
| 5,638,791 | A | 6/1997 | Tsuzuki et al. | |
| 5,664,545 | A | 9/1997 | Kato et al. | |
| 5,816,220 | A * | 10/1998 | Stumpp et al. | 123/435 |
| 6,019,091 | A * | 2/2000 | Spoolstra | 123/496 |
| 6,067,955 | A * | 5/2000 | Boecking | 123/299 |
| 6,119,960 | A | 9/2000 | Graves | |
| 6,283,441 | B1 | 9/2001 | Tian | |
| 6,305,358 | B1 | 10/2001 | Lukich | |
| 6,336,444 | B1 * | 1/2002 | Suder | 123/496 |
| 6,386,185 | B1 * | 5/2002 | Cooke | 123/506 |
| 6,422,211 | B1 * | 7/2002 | Boecking | 123/501 |
| 6,439,201 | B1 | 8/2002 | Gillis et al. | |
| 6,520,151 | B1 | 2/2003 | Desai et al. | |
| 6,526,944 | B1 * | 3/2003 | Hlousek | 123/458 |

OTHER PUBLICATIONS

SAE Paper 980803 dated Feb. 23-26, 1998 entitled "A Common Rial Injection System for High Speed Direct . . . " .
SAE Paper 1999-01-0191 dated Mar. 1-4, 1999 entitled "Common Rial System (CR-System) for Passenger Car DI . . . " .

* cited by examiner

*Primary Examiner*—Carl S. Miller
(74) *Attorney, Agent, or Firm*—Liell & McNeil; Keith Roberson

(57) ABSTRACT

Controlling fuel injectors to create varying injection rates and injection rate shapes typically involves using multiple control valves to control fuel pressure and check valve opening pressure independently. The fuel injector of this application uses a single control valve positioned between a fuel supply passage and a tip supply passage. The control valve has at least three positions. In a second position allowing a first maximum fuel injection rate and allowing a second maximum fuel injection rate in a third position.

17 Claims, 4 Drawing Sheets

METHOD AND APPARATUS FOR CONTROLLING A FUEL INJECTOR

TECHNICAL FIELD

This relates to an internal combustion engine and more specifically to a method and apparatus for controlling a fuel injector.

BACKGROUND

Improved fuel injection systems allow internal combustion engines to increase fuel economy, reduce noxious emissions such as NOx and particulate matter, and increase power. Some of these gains come through increasing pressures of the fuel prior to injection into a combustion chamber. Increased pressures allow for more complete atomization of the fuel to increase the surface area of the fuel. The increased surface area promotes fuller combustion. Increasing the pressure of the fuel at the combustion chamber is accomplished in a number of manners including hydraulic intensification as shown in U.S. Pat. No. 6,305,358 issued to Lukich on 23 Oct. 2001. An alternative system uses an improved fuel pump to deliver high pressure fuel to a common fuel rail as shown in U.S. Pat. No. 5,497,750 issued to Mueller et al on 12 Mar. 1996. In both systems, timing of a fuel injection event may determined by electronic control of a valve such as movement of a solenoid.

However, providing a directly operated check valve or DOC valve provides an additional benefit of more controllability of the fuel injection system.

With a DOC valve, the fuel pressure as well as timing may be varied to create a fuel injection rate shape. By controlling the delivery of hydraulic fluid to a cavity over a check valve, a valve opening pressure needed to open the check valve may be varied. This increased controllability allows the fuel injection system to further lower engine noise and reduce emissions. Fuel from the common rail may also be used in a similar manner.

Control of DOC valve generally requires precise machining including numerous passages machined or cast into an injector body. Improved controllability typically involves using multiple control valves. The additional machining and control valves increase costs of the fuel injection system. Further, multiple control valves may increase actual size of a fuel injector reducing space on a cylinder head of an engine for other needed hardware.

The present invention is directed to overcoming one or more of the problems as set forth above.

SUMMARY OF THE INVENTION

In one embodiment of the present invention, a fuel injector includes an injector body defining a fuel supply passage, and a tip supply passage. A fuel reservoir is positioned between the fuel supply passage and the tip supply passage. A check valve is positioned in a nozzle portion of the injector body (62). The check valve has a head portion and a tip portion. A nozzle reservoir is defined by the nozzle portion and the tip portion and head portion of the check valve. The tip supply passage is in fluid communication with the nozzle reservoir. A control valve is positioned in the fuel reservoir and is control movable to at least a first position, a second position, and a third position. The first position substantially inhibits fluid communication between the fuel supply passage and tip supply passage. The second position restricts fluid communication between the fuel supply passage and the tip supply passage. Fluid communication is allowed between the fuel supply passage and the tip supply passage in the third position.

In another embodiment of the present invention, a fuel system includes a fuel pump in fluid communication with a fuel supply passage. A tip supply passage is in fluid communication with the fuel supply passage. A nozzle reservoir is in fluid communication with the tip supply passage. The nozzle reservoir is defined by a nozzle portion and a check valve. A control valve is disposed between the fuel supply passage and said tip supply passage. The control valve is movable to at least a first position, a second position, and a third position. In the first position fluid communication is substantially inhibited between the fuel supply passage and the tip supply passage. The second position restricts fluid communication between the fuel supply passage and the tip supply passage. The third position allows fluid communication between the fuel supply passage and the tip supply passage.

In yet another embodiment, a method for controlling a fuel injector includes determining an engine operating condition. A control input is sent to the fuel injector. A control valve is positioned according to the control input in one of at least three positions. In the second position a first maximum fuel rate is allowed. The third position allows a second maximum fuel rate.

DETAILED DESCRIPTION

Figure 1:
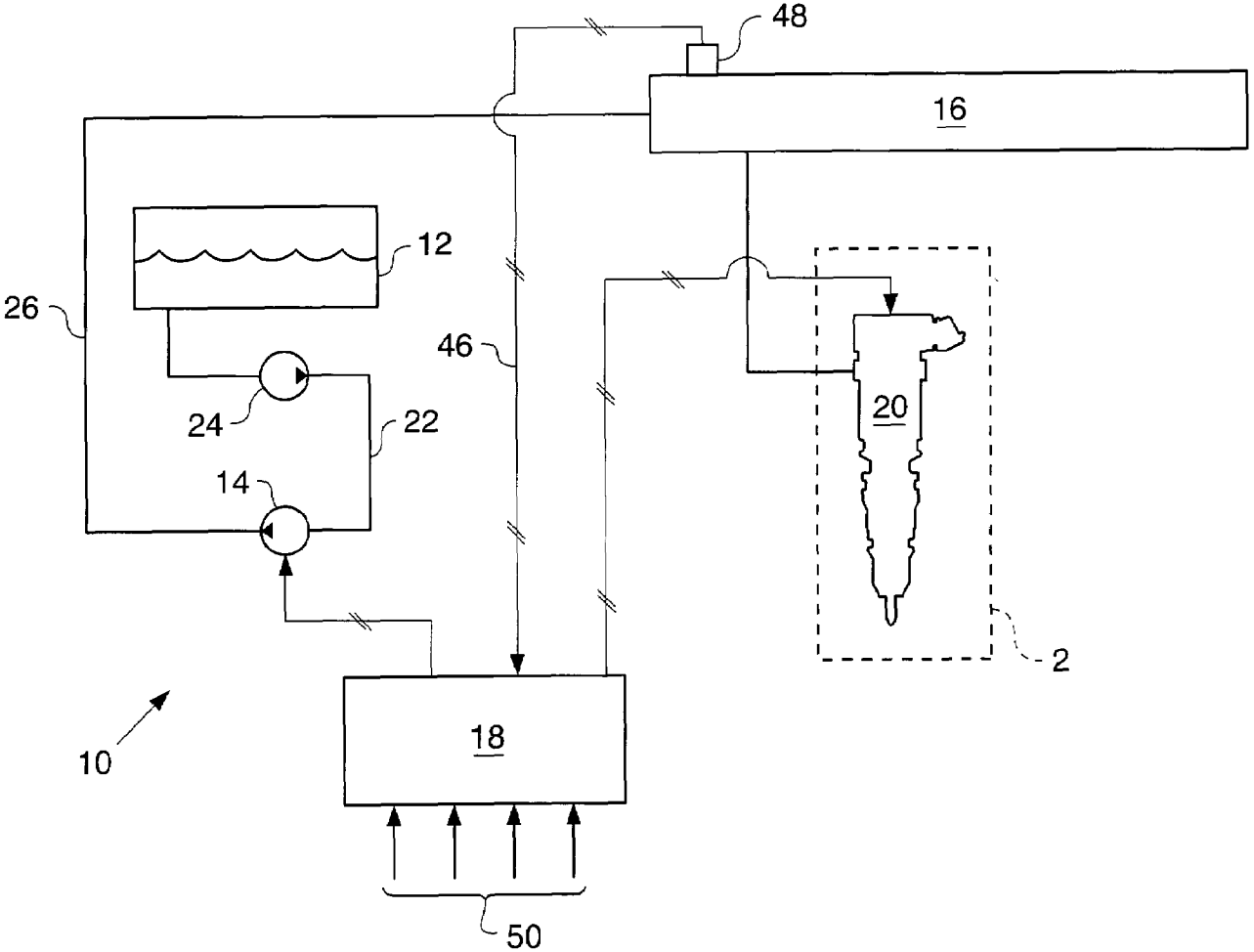
FIG. 1 is a schematic drawing of a fuel system embodying the present invention.

A fuel injection system 10 as shown in FIG. 1 includes a fuel tank 12, a fuel pump 14, fuel manifold or fuel rail 16, a controller 18, and at least one fuel injector 20. A tank supply conduit 22 connects the fuel tank 12 with the fuel pump 14 in a conventional manner. The fuel pump 14 may be replaced by individual pumps for each fuel injector 20 such as cam actuated mechanical unit injectors. Optionally, a fuel lift pump 24 may also connect to the tank supply conduit 22 upstream of the fuel pump 14. A fuel conduit 26 connects the fuel pump 24 with a fuel manifold 16. While this application shows a single fuel manifold 16, each injector 20 may connect with its own fuel manifold 16 or the fuel manifold 16 may connect with some subset of the fuel injectors 20.

In this application, the controller 18 is a conventional electronic control unit. The controller 18 receives a fuel signal 46 from a fuel sensor 48 that may be placed anywhere in the fuel system such as the fuel manifold 16, fuel conduit 26, or the fuel injector 20. The fuel sensor may be adapted to measure one or more conditions of the fuel such as fuel pressure, fuel temperature, or fuel viscosity. The controller 18 also receives one or more engine condition signals 50 from engine sensors (not shown). The engine condition signals are indicative of typical conditions such as air manifold pressure, engine speed, engine load, fuel demand, air humidity, exhaust gas temperature, and air temperature.

Figure 2:
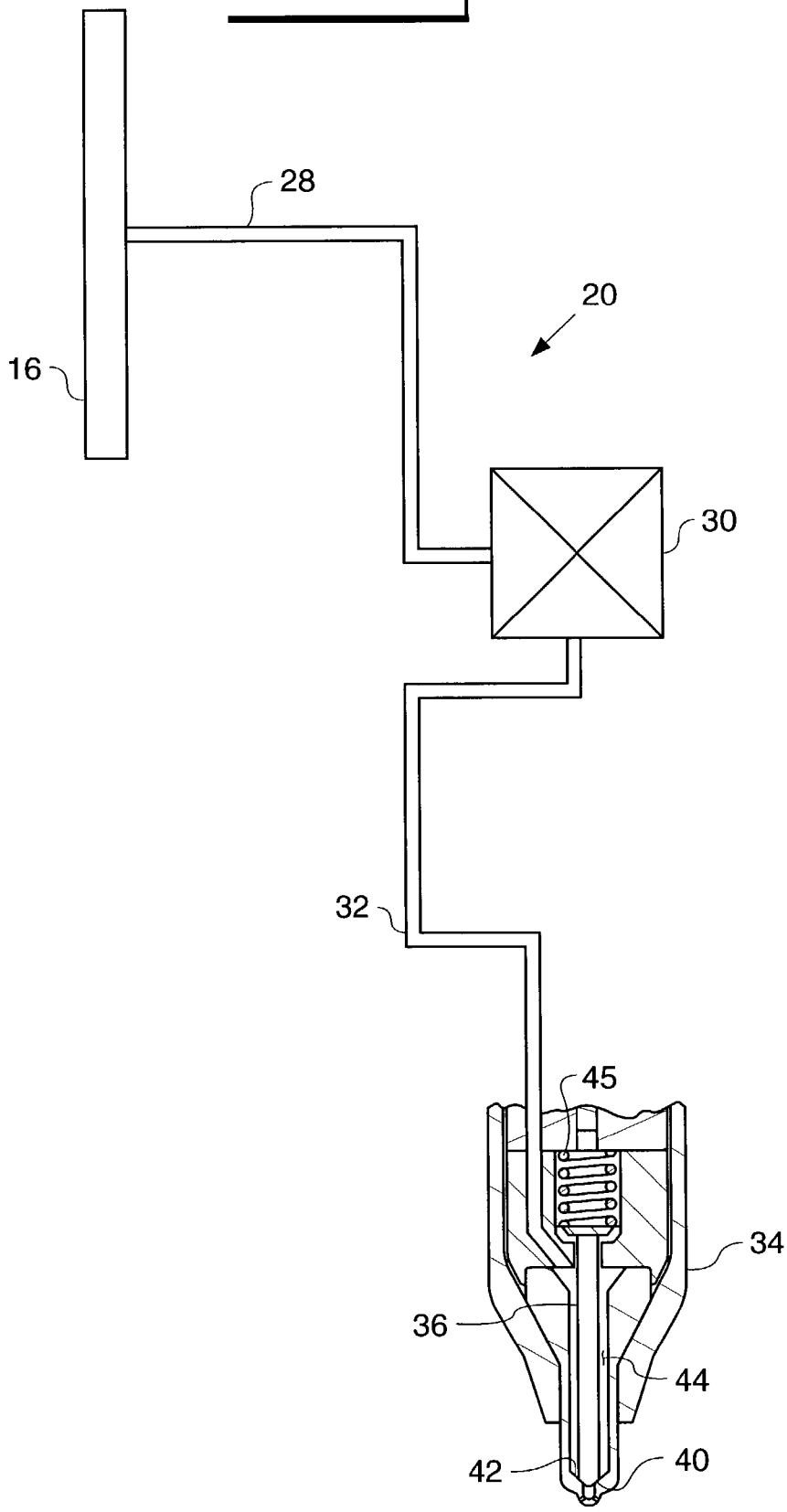
FIG. 2 is a schematic drawing of a fuel injector embodying the present invention.
Figure 3:
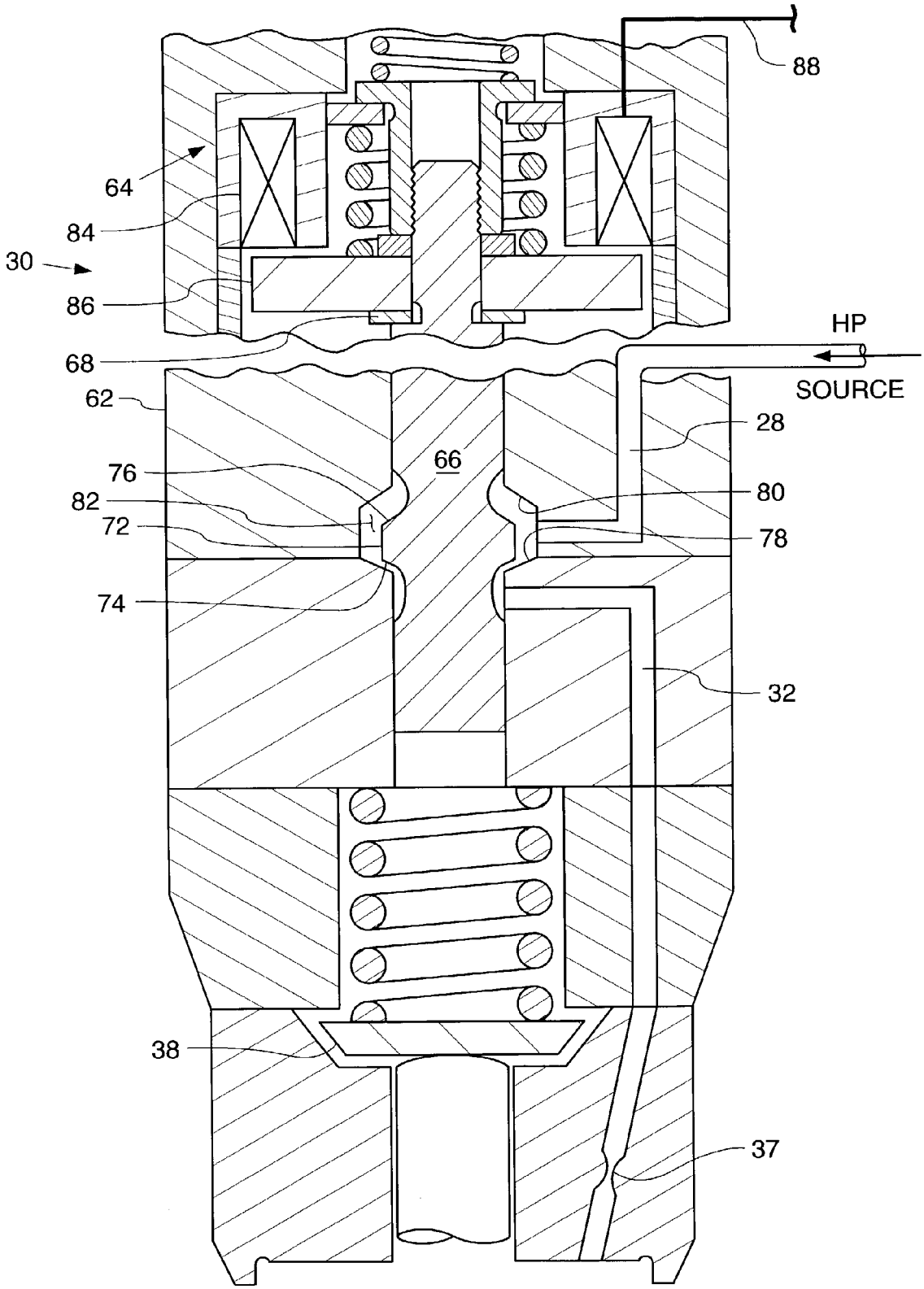
FIG. 3 is a cross section of a control valve from the fuel injector of FIG. 2.

The fuel injector 20 as shown in FIGS. 2 and 3 includes a fuel supply passage 28, a control valve 30, a tip supply passage 32, a nozzle portion 34, and a check valve 36. The fuel supply passage 28 fluidly connects with the fuel manifold 16. The control valve 30 has at least three positions. In both the second and third position the tip supply passage 32 and fuel supply passage 28 are in fluid communication. However, in the first position the tip supply passage 32 and fuel supply passage 28 are substantially inhibited from fluid communication. In the second position the fluid communication between the fuel supply passage 28 and the tip supply passage 32 is restrictive when compared to the third position. An additional flow restriction 37 such as a venturi nozzle or orifice plate may also be place in the tip supply passage 32 between the control valve 30 and the nozzle portion 34.

The check valve 36 is positioned in the nozzle portion 34. The check valve 36 has a head portion 38 and a tip portion 40 distal from the head portion 38. The tip portion 40 is proximate to a seating portion 42 of the nozzle portion 34. The nozzle portion 34 and check valve 36 define a nozzle reservoir 44 between said head portion 38 and said tip portion 40. In an embodiment, a spring 45 is connected to the head portion 38.

As shown in FIG. 3, the control valve 30 in an embodiment is positioned in an injector body 62. The control valve 30 includes a valve actuator 64 and a poppet 66 having an actuation portion 68 and a control portion 72. The control portion 72 includes a first control seal portion 74 and a second control seal portion 76. The injector body 62 includes a first body seal portion 78 and a second body seal portion 80. The poppet 66 is movable in said injector body 62 between the first position of the control valve (where the first control seal portion 74 is in sealing connection with the first body seal portion 78) and the third position (where the second control seal portion 76 is in sealing connection with the second body seal portion 80). The poppet 66 and injector body 62 define a fuel reservoir 82 that may fluidly connect the fuel supply passage 28 with the tip supply passage 32. While this embodiment shows a sliding poppet 66, any conventional valve operation may be used such as a rotating valve or spool valve.

The actuation portion 64 for this embodiment includes a solenoid 84 and an armature 86. The solenoid 84 operates at multiple power levels such as multiple currents or voltages. The armature 86 connects with the actuation portion 68 in a conventional manner. The controller 18 provides a control input 88 to the solenoid 84. Alternatively, the actuation portion 68 may be any conventional actuation mechanism such as a piezo-electric actuator.

Figure 4A:
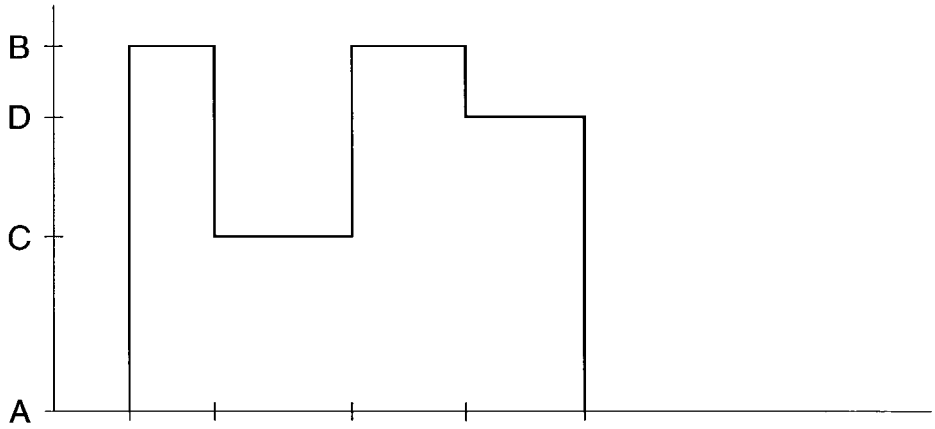
FIG. 4 is a graph of aspects with respect to time of the fuel injector embodying the present invention.
Figure 4B:
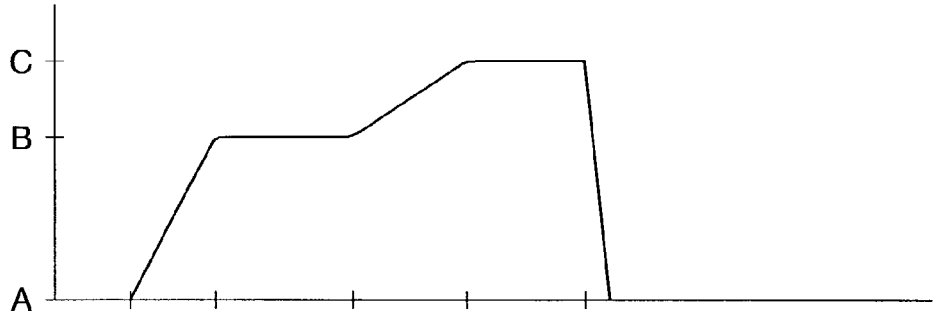
Figure 4C:
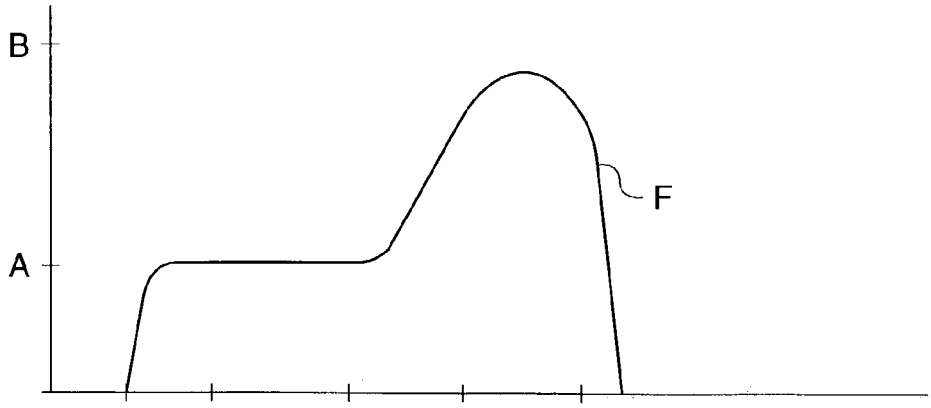

In an embodiment, the control input 88 to the solenoid 84 as shown in FIG. 4A (shown with respect to time) is one of four currents "a", "b", "c", or "d". Currents "a", "c", and "d" correspond with armature positions "a", "b", "c" respectively as shown in FIG. 4B. The first position of the control valve 30 corresponds with armature position "a". The third position of the control valve 30 corresponds with armature position "c". FIG. 4C shows a boot shape fuel injection rate curve where the check valve 36 is connected only with the spring 45. The boot type fuel injection rate curve "F" is shown having a stable injection rate having a first maximum flow rate "a" followed by a ramp injection rate having a second maximum flow rate "b". The fuel injector 20 may be instead used to create only the stable injection rate "a" or the ramp injection rate "b" or other combinations of conventional fuel injection shapes such as a post injection or pilot injection (not shown) at either the first maximum flow rate or the second maximum flow rate.

Industrial Applicability

In operation fuel flows from the fuel tank 12 into the fuel pump 14 where fuel pressure is increased to pressures suitable for atomizing liquid fuel as it exits the nozzle portion 34 of the fuel injector 20. The fuel lift pump 24 may be used to transmit fuel to the fuel pump 14. Fuel passes through the fuel conduit 26 into the fuel manifold 16 where high pressure fuel may be stored or accumulated prior to entering the fuel injector 20. Alternatively, fuel may be pressurized after exiting the fuel manifold 16 in cases where the fuel pump 14 is associated with a fuel injector 20.

Functionally, fuel passes from the manifold 16 into a fuel supply passage 28 that may be inside or outside the fuel injector body 62. As the controller 18 receives the engine condition signal 50 and fuel signal 46, the controller 18 sends the control input 88 to direct the control valve 30 into one of the three positions. In the first position, no substantial quantity of fuel passes into nozzle reservoir 44 to act against the check valve 36. In the second position, the control valve 30 allows some fuel to pass through the fuel supply passage 28 into the nozzle reservoir 44. However, partial restriction of fluid communication between the fuel supply passage 28 and tip supply passage 32 reduces pressures in the nozzle reservoir 44 and fuel injection rates from the nozzle portion 34. Moving the control valve 30 to the third position reduces restrictions in fluid communication between the fuel supply passage 28 and tip supply passage 32 to increase pressure at the nozzle reservoir 44 and thus injection rate from the nozzle portion 34.

Using the poppet 66, the fuel is essentially contained in the fuel reservoir 82 where the solenoid is at current level a and corresponding armature position "a". To get the stable injection rate "a", current level "b" is sent initially to the solenoid to move armature 86 to armature position b and current level "c" holds the armature 86 in position. As the armature 86 moves to position "b", fuel passes from the fuel reservoir 82 into the tip supply passage 32. However, the poppet 66 restricts fuel flow through the fuel reservoir 82 and reduces fuel pressure. Fuel from the tip supply passage 32 builds pressure in the nozzle reservoir 44. Fuel applies force to the check valve 36 near the head portion 38 causing the check valve 36 to act against the spring 45 and move the tip portion away from the seating portion 42 of the nozzle portion 34.

To create the ramp injection rate "b", the current level "b" is sent to the solenoid 84 to move the armature 86 from either position "a" or position "b" to position "c". Fuel flows from the supply passage 28 through the fuel reservoir 82 into the tip supply passage 32 with less restriction to flow than exhibited where the armature 86 is in position "b". Again fuel applies force to the check valve 36 to move the tip portion 40 away from the seating portion 42. Due to reduced restrictions, fuel pressures experienced at the tip portion 40 are greater and result in the ramp injection rate b.

Using the control valve 30 to restrict flow between the fuel supply passage 28 and tip supply passage 32 allows a fuel injector 20 to perform various injection patterns without using two control valves. Adding the flow restriction 37 in the tip supply passage allows further control of fuel injection. Other aspects, objects and advantages of this invention can be obtained from a study of the drawings, the disclosure and the appended claims.

What is claimed is:

1. A fuel injector, comprising:

an injector body defining a fuel supply passage, a tip supply passage, and a fuel reservoir positioned between said fuel supply passage and said tip supply passage, and injector body having a nozzle portion;

a check valve positioned in said nozzle portion, said check valve having a head portion and a tip portion, said nozzle portion, said head portion and said tip portion defining a nozzle reservoir, said tip supply passage in fluid communication with said nozzle reservoir; and a control valve positioned in said fuel reservoir, said control valve movable to at least a first position, a third position, and a second position between said first and third positions, said first position is a no injection position substantially inhibiting fluid communication between said fuel supply passage and said tip supply passage, said second position is a reduced injection rate position restricting fluid communication between said fuel supply passage and said tip supply passage, said third position is an increased injection rate position allowing unrestricted fluid communication between said fuel supply passage and said tip supply passage.

2. The fuel injector as set out in claim 1 including a solenoid adapted to actuate said control valve.

3. The fuel injector as set out in claim 2 wherein said solenoid is operable at least two energy levels and a no energy level corresponding to the first position.

4. The fuel injector as set out in claim 1 wherein said control valve includes a poppet, which is trapped to move between first and second seats.

5. The fuel injector as set out in claim 1 wherein said control valve includes a piezo-electric actuator.

6. The fuel injector as set out in claim 1 wherein said check valve is connected with a spring.

7. The fuel injector as set out in claim 1 including a flow restriction in said tip supply passage.

8. The fuel injector as set out in claim 4 wherein said restriction is a venturi meter.

9. A fuel injection system, comprising:

a fuel common rail;

a fuel supply passage in fluid communication with said fuel common rail;

a tip supply passage in fluid communication with said fuel supply passage;

a nozzle portion having a check valve being disposed therein, said check valve and said nozzle portion defining a nozzle reservoir, said nozzle reservoir being in fluid communication with said tip supply passage; and a single control valve disposed between said nozzle reservoir and said fuel common rail, said control valve being movable to at least a first position, a third position, and a second position between said first and third positions, said first position is a no injection position substantially inhibiting fluid communication between said fuel supply passage and said tip supply passage, said second position is a reduced injection rate position restricting fluid communication between said fuel supply passage and said tip supply passage, said third position is an increased injection rate position allowing unrestricted fluid communication between said fuel supply passage and said tip supply passage.

10. The fuel injection system as set out in claim 9 wherein said control valve is positioned in an injector body, said valve body being connected with said tip portion.

11. The fuel injection system as set out in claim 9 wherein said fuel supply passage is defined by injector body.

12. The fuel injection system as set out in claim 9 including a solenoid connected with said control valve that includes a poppet trapped to move between first and second seats.

13. The fuel injection system as set out in claim 12 wherein said solenoid has at least two energy states and an off energy state corresponding to the first position: and one of the at least two energy states corresponding to said second position, at which said poppet is out of contact with the first and second seats.

14. The fuel injection system as set out in claim 9 including a controller connected with said control valve.

15. A method for operating a fuel injector comprising:

determining an engine operating condition;

sending a control input to the fuel injector according to the engine operating conditions;

positioning a single control valve in one of at least three positions corresponding to said control input, initiating an injection by moving the single control valve from a first position toward on of a second and third position;

ending an injection by moving the single control valve toward the first position;

the first position being a closed position providing no fuel injection, the third position being a fully open position allowing a second maximum fuel injection rate; and the second position being a partially open position between the first and third positions allowing a first maximum fuel injection rate that is less than the second maximum fuel injection rate.

16. The method for operating the fuel injector as set out in claim 15 wherein said control input is supplying one of at least three energy levels.

17. The method of operating the fuel injector as set out in claim 15 wherein said positioning is sliding a poppet to one of three positions.

* * * * *

UNITED STATES PATENT AND TRADEMARK OFFICE

CERTIFICATE OF CORRECTION

PATENT NO. : 7,124,746 B2
APPLICATION NO. : 10/196645
DATED : October 24, 2006
INVENTOR(S) : Douglas S. Brocco et al.

It is certified that error appears in the above-identified patent and that said Letters Patent is hereby corrected as shown below:

On the Title Page, under Other Publications item 56, please replace two instances of the word "Rial" with the correct spelling of --Rail--.

Signed and Sealed this

Nineteenth Day of June, 2007

JON W. DUDAS
*Director of the United States Patent and Trademark Office*